US009320322B1

(12) United States Patent
Castaneda et al.

(10) Patent No.: US 9,320,322 B1
(45) Date of Patent: Apr. 26, 2016

(54) SHOE SECURING SYSTEM

(71) Applicants: Joel Cruz Castaneda, Clermont, FL (US); Ayesha Tonya Castaneda, Clermont, FL (US)

(72) Inventors: Joel Cruz Castaneda, Clermont, FL (US); Ayesha Tonya Castaneda, Clermont, FL (US)

( * ) Notice: Subject to any disclaimer, the term of this patent is extended or adjusted under 35 U.S.C. 154(b) by 0 days.

(21) Appl. No.: 14/491,764

(22) Filed: Sep. 19, 2014

Related U.S. Application Data

(60) Provisional application No. 61/892,133, filed on Oct. 17, 2013.

(51) Int. Cl.
*A43C 11/00* (2006.01)

(52) U.S. Cl.
CPC ..... *A43C 11/00* (2013.01); *Y10T 24/37* (2015.01); *Y10T 24/3742* (2015.01); *Y10T 24/3787* (2015.01)

(58) Field of Classification Search
CPC .... A43C 11/00; Y10T 24/37; Y10T 24/3742; Y10T 24/3787
See application file for complete search history.

(56) References Cited

U.S. PATENT DOCUMENTS

| | | | | |
|---|---|---|---|---|
| 853,638 | A | 5/1907 | Heisdorf | |
| 1,635,884 | A | 7/1927 | Gilewicz | |
| 3,137,952 | A * | 6/1964 | Shears | 36/50.1 |
| 4,777,705 | A * | 10/1988 | Ingram | 24/453 |
| 4,790,048 | A * | 12/1988 | Arnt | 24/712.1 |
| 4,907,352 | A | 3/1990 | Ginsberg | |
| 5,148,614 | A * | 9/1992 | Kelly | 36/50.1 |
| 5,165,190 | A | 11/1992 | Smyth | |
| 5,203,053 | A | 4/1993 | Rudd | |
| 5,214,826 | A * | 6/1993 | Fortune | 24/575.1 |
| 5,412,852 | A | 5/1995 | Smaragdas | |
| 5,526,585 | A * | 6/1996 | Brown et al. | 36/50.1 |
| 5,557,864 | A * | 9/1996 | Marks | 36/50.1 |
| 5,894,640 | A * | 4/1999 | Dewey | 24/306 |
| 6,622,357 | B2 | 9/2003 | Jackson et al. | |
| 7,793,436 | B2 * | 9/2010 | Sink | 36/50.1 |
| 2006/0254089 | A1 * | 11/2006 | Frydlewski | 36/50.1 |
| 2009/0242439 | A1 | 10/2009 | Talley | |
| 2010/0293767 | A1 | 11/2010 | Talley | |
| 2010/0325849 | A1 | 12/2010 | Clayton | |
| 2011/0289743 | A1 * | 12/2011 | Hill | 24/713.6 |
| 2012/0117820 | A1 | 5/2012 | Atamian | |
| 2013/0263473 | A1 * | 10/2013 | Young | 36/83 |

* cited by examiner

*Primary Examiner* — Robert J Sandy
*Assistant Examiner* — Louis Mercado
(74) *Attorney, Agent, or Firm* — H. John Rizvi; Gold & Rizvi, P.A.

(57) ABSTRACT

A shoe securing system is disclosed including a shoe attachment strap unit having a pair of female fasteners configured to mate with a pair of male fasteners. The shoe attachment strap unit is longitudinally elastic, and can include a fabric section and an elastic section defining a strap main body. One of the females fasteners can be provided on a separate attachment feature affixed to a bottom surface of the strap main body at one end thereof. The male fasteners can be integrally formed on a shoe upper, or be formed as separate parts to be attached to the female fasteners through shoelace eyelets or other eyelets of a shoe upper. The male fasteners and female fasteners attach through friction.

14 Claims, 6 Drawing Sheets

SHOE SECURING SYSTEM

FIELD OF THE INVENTION

The following disclosure generally relates to a footwear securing device and method of use, and, more particularly to a footwear securing device including mating fasteners that enable quick attachment and detachment for adjustably securing and removing footwear from a user's foot.

BACKGROUND OF THE INVENTION

Many traditional footwear options require the incorporation of methods to tighten or loosen footwear to secure and remove the footwear to a user's foot. Despite a plethora of standard sizes being available in the market, some smaller adjustments may be needed for an individual's foot size. Footwear that does not have enough room may cause cramping, while footwear with too much room may cause irritation from friction or unstable footing during motion. A common method of adjusting the fit of footwear is shoelaces. Shoelaces bridge the gap between two opposing sections of a shoe upper, the shoelace typically tied proximate a shoe tongue centrally disposed between each opposing shoe upper section, to retain a desired fit.

While shoelaces are common, utilizing them for the adjustment of footwear has drawbacks. Shoelaces are susceptible to fading, dirt, and wear. Also, laces are typically looped or woven back and forth across the tongue and shoe upper through a serial of eyelets, which is complicated and time-consuming. The series of eyelets typically include metal rings integrated into the upper sections, which are required to receive threaded and/or looped shoelace strings. Additionally, the shoelaces must be tied in a knot to retain the desired tension and assist in preventing the shoelaces from progressively loosening with movement. A knot must be tied in such a way that is tight enough to prevent slippage, yet loose enough to be untied without excessive effort. The excess string of the shoelaces extending from the knot can often be caught on objects while walking or come loose during normal use of the footwear.

Accordingly, there remains a need in the art for an apparatus and method to secure footwear in such a way that it provides a selectively adjustable fastener, yet avoids the negative drawbacks of the commonly used shoelace. In particular, a securing apparatus and method that enables precise adjustment, durability, and ease of use is needed.

SUMMARY OF THE INVENTION

The basic inventive concept provides a shoe securing system that provides selectively adjustable fasteners, while avoiding the negative drawbacks associated with the prior art shoelaces. In particular, the shoe securing system of the present invention is based on an elastically (resiliently) deformable strap unit including female fasteners on opposite ends of the strap unit, for receiving two corresponding male fasteners which, for instance, can be integrally formed on opposite sides of a shoe upper, or can be built as separate parts to be inserted through and from beneath shoelace eyelets on opposite sides of a shoe upper. In order to facilitate attaching and detaching the strap unit, the strap unit can be comprised of a strap body and a separate strap attachment section; one of the female fasteners is provided on the separate strap attachment section while the other female fastener is provided on the strap. The strap and the strap attachment section are removably and selectively engageable by respective attachment features (such as a hook-and-loop fastener), facilitating securing or releasing of the shoe without having to unfasten the male-female connections on both ends of the strap unit.

In accordance with a first embodiment of the invention, the present invention consists of a shoe securing system comprising:

a strap attachment section including a first female fastener defining a first male receiving aperture, and further including an attachment feature;

a shoe attachment strap including a strap main body, wherein said strap main body comprises:

- a first end and an opposed second end arranged along a longitudinal direction,
- an attachment feature, affixed to a bottom surface of the strap main body at said first end, said attachment feature being adapted for selective engagement to the strap attachment section attachment feature, and
- a second female fastener integrated into said second end, the second female fastener defining a second male receiving aperture; and a first and second male fastener adapted for frictional engagement and retention within the respective first and second male receiving apertures.

In accordance with a second embodiment of the invention, the present invention consists of a shoe securing system comprising:

a strap attachment section including a first female fastener defining a first male receiving aperture, and further including an attachment feature; and a shoe attachment strap including a strap main body, wherein said strap main body comprises:

- a first end and an opposed second end arranged along a longitudinal direction,
- an attachment feature, affixed to a bottom surface of the strap main body at said first end, said attachment feature being adapted for selective engagement to the strap attachment section attachment feature, and
- a second female fastener integrated into said second end, the second female fastener defining a second male receiving aperture.

Introducing yet another embodiment of the invention, the present invention consists of a shoe securing system comprising:

a shoe attachment strap unit, having an elongated shape along a longitudinal direction, said shoe attachment strap unit being elastically deformable along said longitudinal direction, said shoe attachment strap unit including:

- a first end and an opposed second end arranged along said longitudinal direction,
- a first female fastener integrated into said first end, the first fastener defining a first male receiving aperture;
- a second female fastener integrated into said second end, the second female fastener defining a second male receiving aperture; and a first and second male fastener adapted for frictional engagement and retention within the respective first and second male receiving apertures.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

Figure 1:
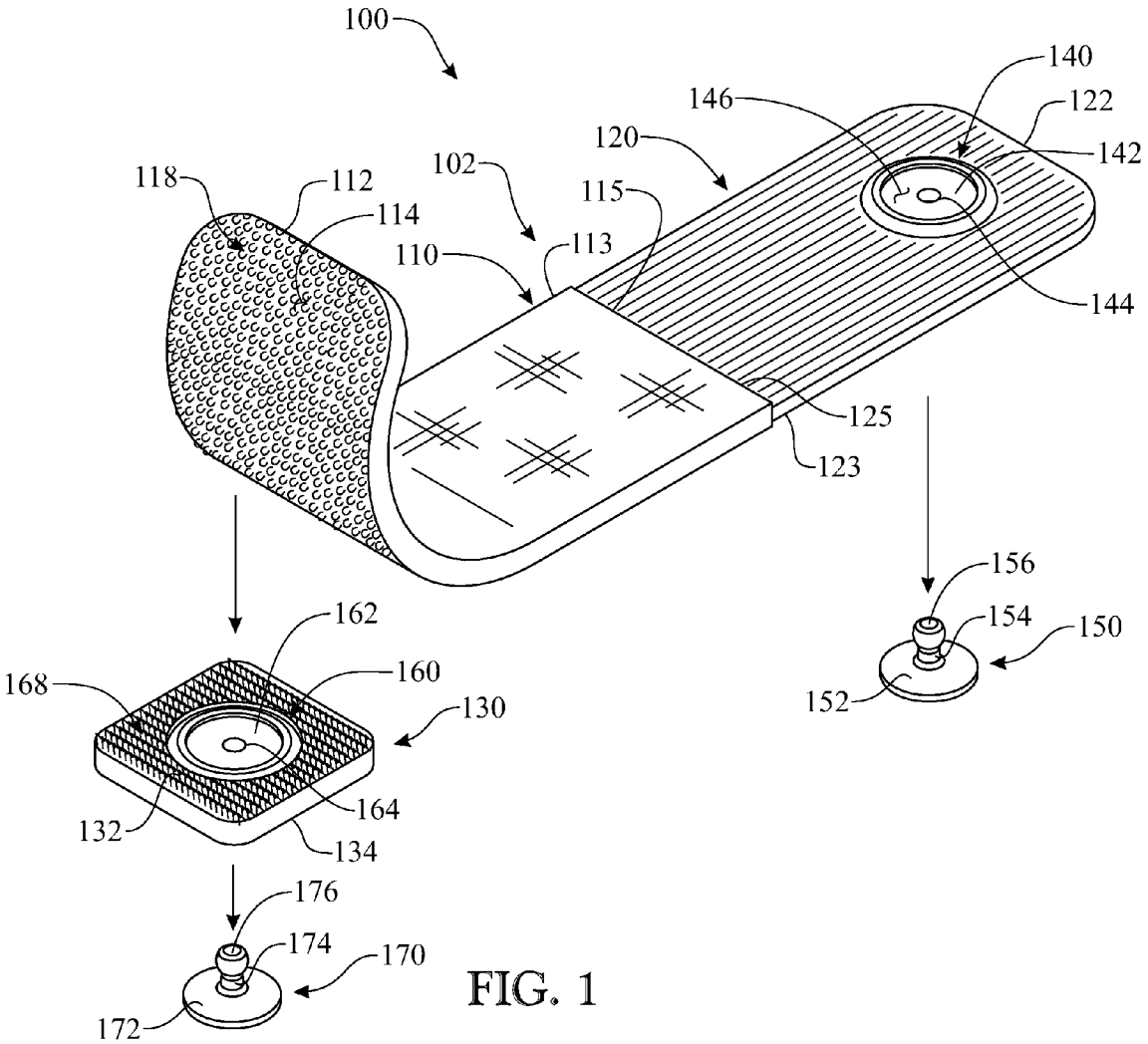
FIG. 1 presents an exploded isometric view of the shoe securing system in an exemplary embodiment of the invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

A first exemplary embodiment, referred to as a shoe securing system 100, is illustrated in FIGS. 1 through 5. The shoe securing system 100 includes a strap main body 102, i.e., an elongated body arranged in a longitudinal direction, adapted for selective attachment to a strap attachment section 130 and a pair of male fasteners 150, 170.

Referring initially to FIG. 1, the strap main body 102 is segmented into a fabric section 110 and an elastic section 120. The fabric section 110 presents a first end 112, a second end 113 and a lateral edge 115 at the second end 113. Similarly, the elastic section 120 presents a first end 122, a second end 123 and a lateral edge 125 at the second end 123. The respective lateral edges 115, 225 at the second ends 113, 123 of the fabric section 110 and the elastic section 120 are affixed one to the other. The affixed fabric section 110 and elastic section 120 define the strap main body 102. Although the exemplary embodiment is segmented into an elastic section 120 and a fabric section 110, it is understood that the sections can be made of any known material. The elastic section 120 can be fabricated of any known elastic material, such as an elastic polymer material, provided that it possesses the required elasticity to be stretched across a shoe tongue 210 (FIG. 4), retained at the stretched length when fastened, and returned to a default state when unfastened. The fabric section 110 can be made of any reasonable material, including fabric, leather, denim, canvas, polyester, vinyl, ribbon, elastic, and the like. An attachment feature 118 is affixed to a bottom surface 114 of the fabric section 110, the attachment feature 118 shown implemented as a plurality of loops, adapted for engagement to a plurality of mating hooks disposed on the strap attachment section 130, forming a hook-and-loop attachment system at one end of the strap main body 102. An elastic section female fastener 140 is integrated at the first end 122 of the elastic section 120, the elastic section female fastener 140 shown implemented as a circular body 142 defining a male fastener receiving aperture 144 adapted to receive the corresponding male fastener 150 therethrough.

The strap attachment section 130 also includes a strap attachment section female fastener 160 integrated therein, the strap attachment section female fastener 160 shown implemented as a circular body 162 defining a male fastener receiving aperture 164 adapted to receive the corresponding male fastener 170 therethrough. An attachment feature 168 is affixed to a top surface 132 of the strap attachment section 130, the attachment feature 168 shown implemented as plurality of hooks affixed to the top surface 132 of the strap attachment section 130, the plurality of hooks adapted for engagement to the plurality of mating loop-type attachment feature 118 disposed on the bottom surface 114 of the fabric section 110. The strap attachment section 130 is shown implemented as a square piece having slightly rounded corners, however, it is understood that the strap attachment section 130 can be formed in any multitude of shapes and materials. In the present embodiment, the attachment feature 168 surrounds the female fastener 160 and does not conceal said fastener; however, alternative embodiments are contemplated in which the attachment feature 168 covers the female fastener 160, providing a larger hook-type surface and thus a stronger attachment to the mating loop-type attachment feature 118 of the strap main body 102.

Figure 2:
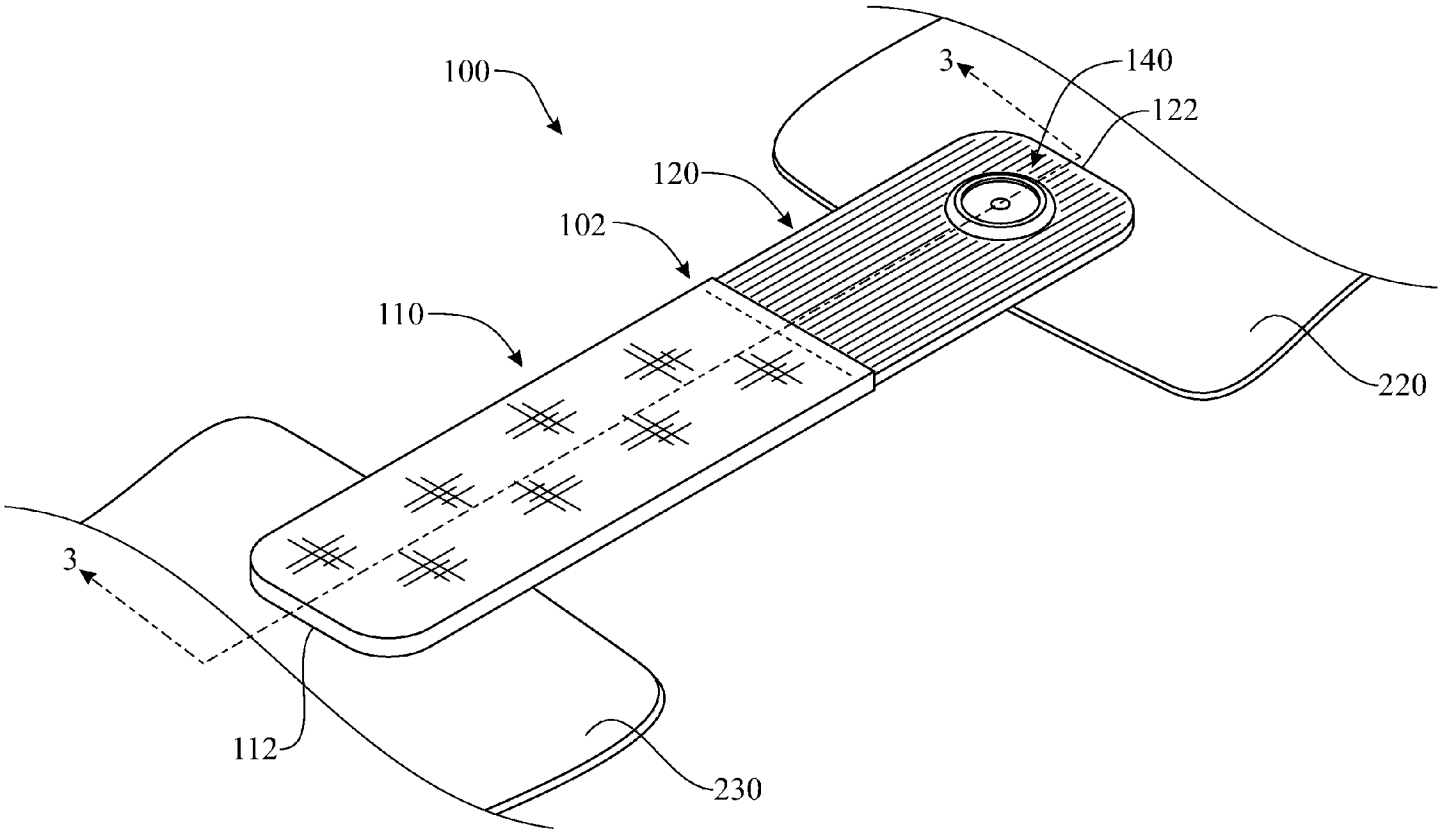
FIG. 2 presents an isometric view of the shoe securing system originally introduced in FIG. 1, shown in a fastened assembled configuration.

Preferably, the strap attachment section 130 is configured to fit beneath the strap main body 102 when the attachment feature 168 of the strap attachment section 130 is engaged to the mating strap main body attachment feature 118. In other words, the strap attachment section the top surface 132 fits inside the bottom surface 114 of the fabric section 110. In other words, once engaged, the main body 102 conceals the strap attachment section 130 as shown in FIG. 2. The aesthetical finish of the shoe securing system is therefore sleek, allowing the mechanisms involved in the attachment to remain essentially hidden from the observer's eye by the strap main body 102.

Each of the male fasteners 150, 170 is adapted for selective attachment to the respective female fasteners 140, 160. In the exemplary embodiment, the male fasteners 150, 170 are shown as projecting male snap-type fasteners. Each male fastener 150, 170 is comprised of a bulbous member 176 disposed on top of and being supported by a neck member 174, the neck member 174 having a more narrow width than a width of the bulbous member 176 and the neck member 174 extending upwardly from a circular base 172. The bulbous member 176, neck member 174, and base 172 are preferably formed as an integral body. The size and shape of the bulbous member 176 is adapted to be forcibly inserted within the receiving aperture 164 in the female fastener 160 for frictional engagement and retention within the receiving aperture 164, as will be described in more detail with reference to FIG. 3. The male fastener 150, including a bulbous member 156, a neck member 154, and a base 152, is identical in function and operation to the male fastener 170, except that the male fastener 150 is utilized with the female fastener 140.

Referring now generally to FIG. 2, the shoe securing system 100 is illustrated, wherein the strap main body 102 is attached to a shoe upper. More particularly, the first end 112 of the fabric section 110 is attached to a first shoe upper section 230 and the first end 122 of the elastic section 120 is attached to a second shoe upper section 220.

Figure 3:
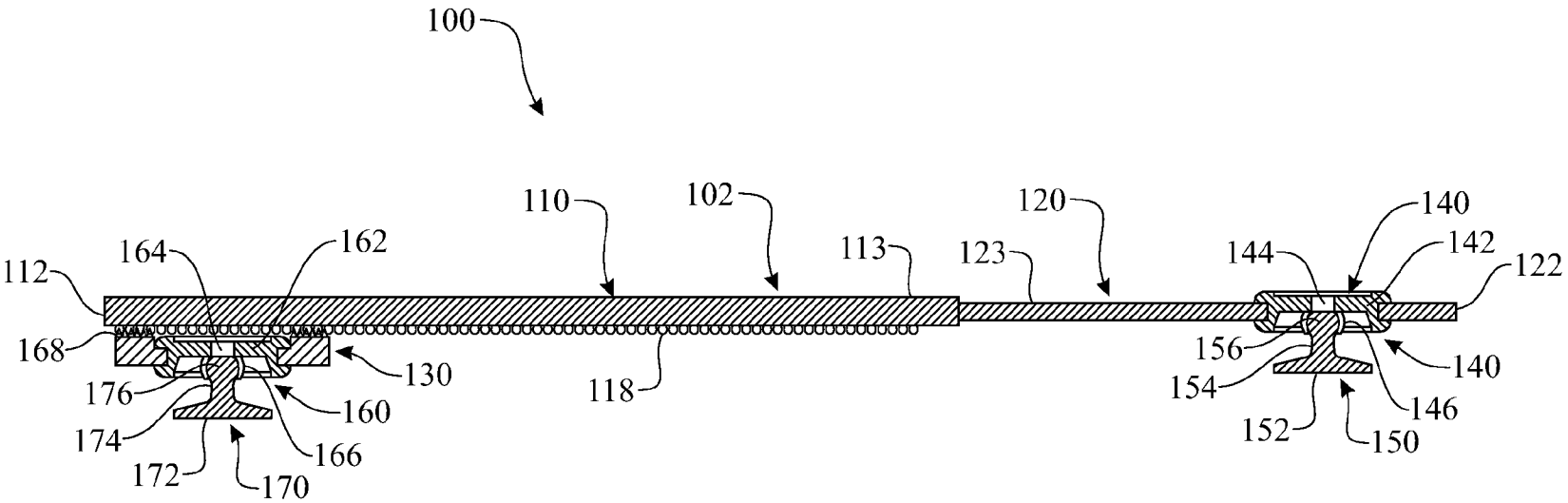
FIG. 3 presents a cross-sectional view of the shoe securing system originally introduced in FIG. 1, taken along section line 3-3 of FIG. 2.

Referring generally to FIG. 3, the shoe securing system 100 is illustrated in an attached assembled configuration in a sectional view. The respective second ends 113, 123 of the fabric 110 and elastic section 110 are affixed one to the other, forming the strap main body 102. The loop-type attachment feature 118 and the hook-type attachment feature 168 are matingly attached to one another, forming an attachment of the strap attachment section 130 to the fabric section 110 at the first end 112 thereof. The female fastener 160 further includes a bulbous member receiving sidewall 166 defining a bulbous member receiving cavity sized and configured to frictionally engage and frictionally retain the bulbous member 176 therein. Likewise, the female fastener 140 further includes a bulbous member receiving sidewall 146 defining a bulbous member receiving cavity sized and configured to frictionally engage and frictionally retain the bulbous member 146 therein.

Although not shown in FIG. 3, the male fasteners 150, 170 can be implemented within the shoe securing system 100 in a multitude of ways. For example, the male fasteners 150, 170 can be integrally formed with the corresponding shoe upper sections 220, 230 such that the bulbous member 156, 176 protrudes from a top surface of the shoe upper section 220, 230 for being snapped into the respective female fastener 140, 160. This implementation is advantageous in that the number of elements needed in order to tie the shoe is reduced, as the male fasteners 150, 170 are integral to the shoe.

In another example, the male fasteners 150, 170 can be independent, separate elements of the shoe securing system 100. In this manner, a user could use the system 100 with pre-existing shoes that include shoelace eyelets along the shoe tongue engaging edges of the respective shoe upper sections 220, 230. The male fastener receiving apertures 144, 164 of the female fasteners 140, 160 can be positioned at a top of the respective shoe upper sections 220, 230 and aligned concentrically with the shoelace eyelets. Thus, the male fasteners 150, 170 can be snapped into the female fasteners 140, 160 from the underside of the shoe upper sections 220, 230, securing each of the strap sections 110, 120 to the respective shoe upper section 220, 230. Such an arrangement is advantageous in that the system can be used with virtually any pair of existing shoes that is provided with shoelace eyelets, and in fact can be used interchangeably, i.e., easily switched from one pair of shoes to another.

Figure 4:
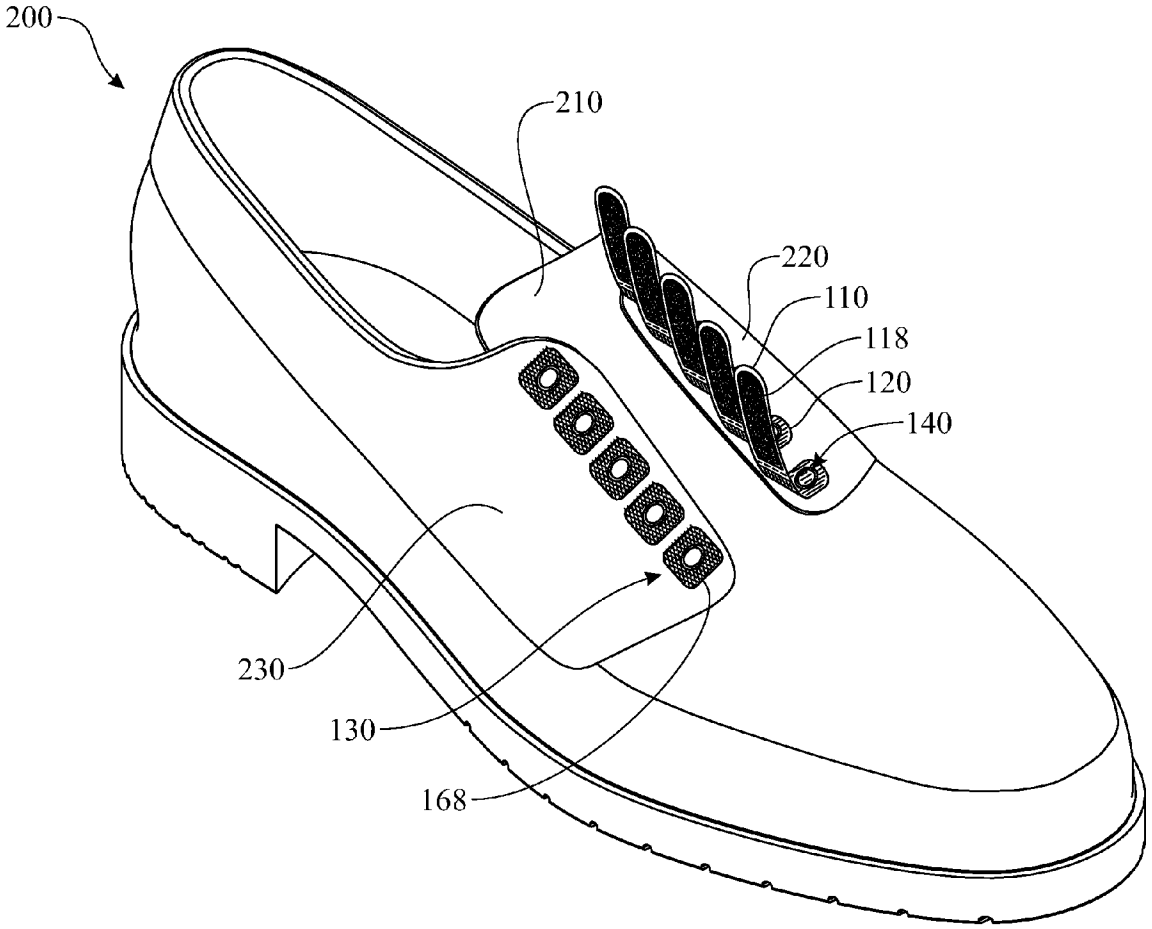
FIG. 4 presents an isometric view of the shoe securing system originally introduced in FIG. 1, illustrating the system in an unfastened configuration on a shoe.
Figure 5:
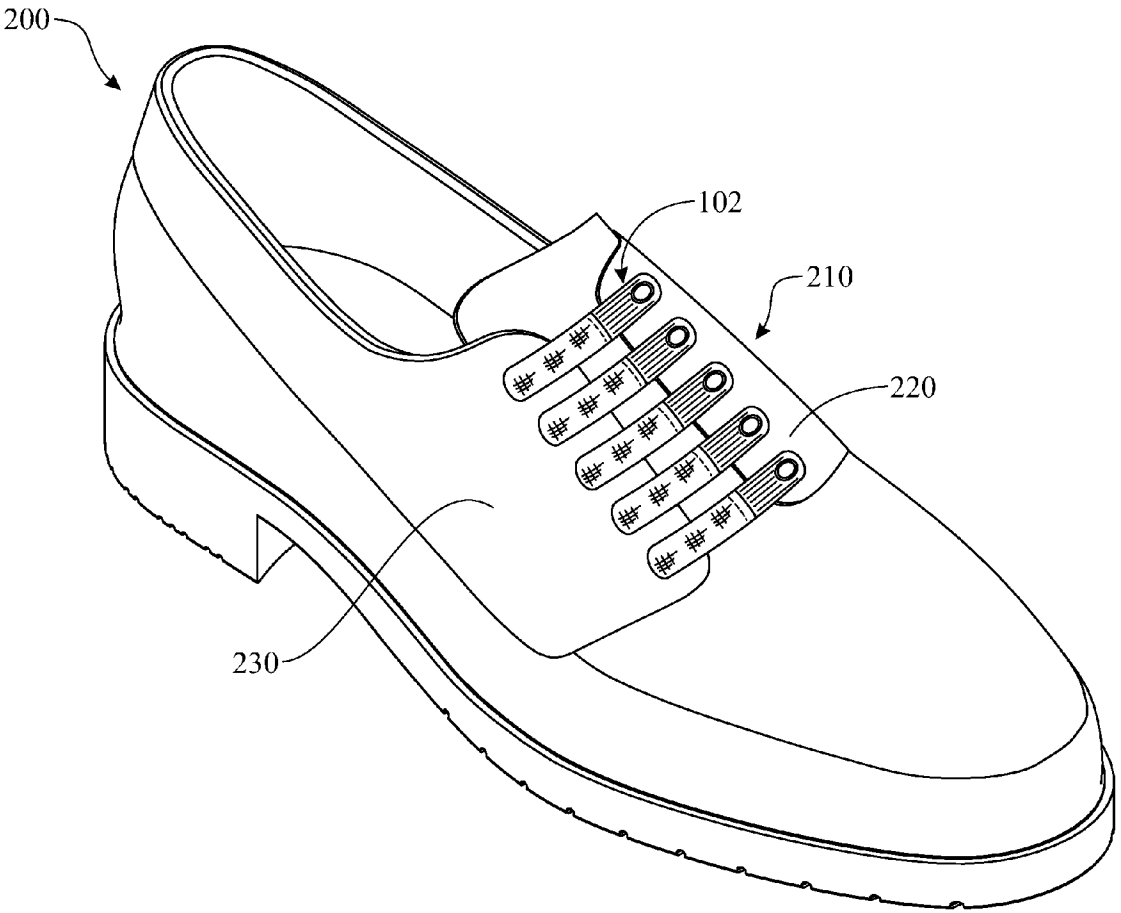
FIG. 5 presents an isometric view of the shoe securing system originally introduced in FIG. 1, illustrating the system in a fastened configuration on the shoe.
Figure 6:
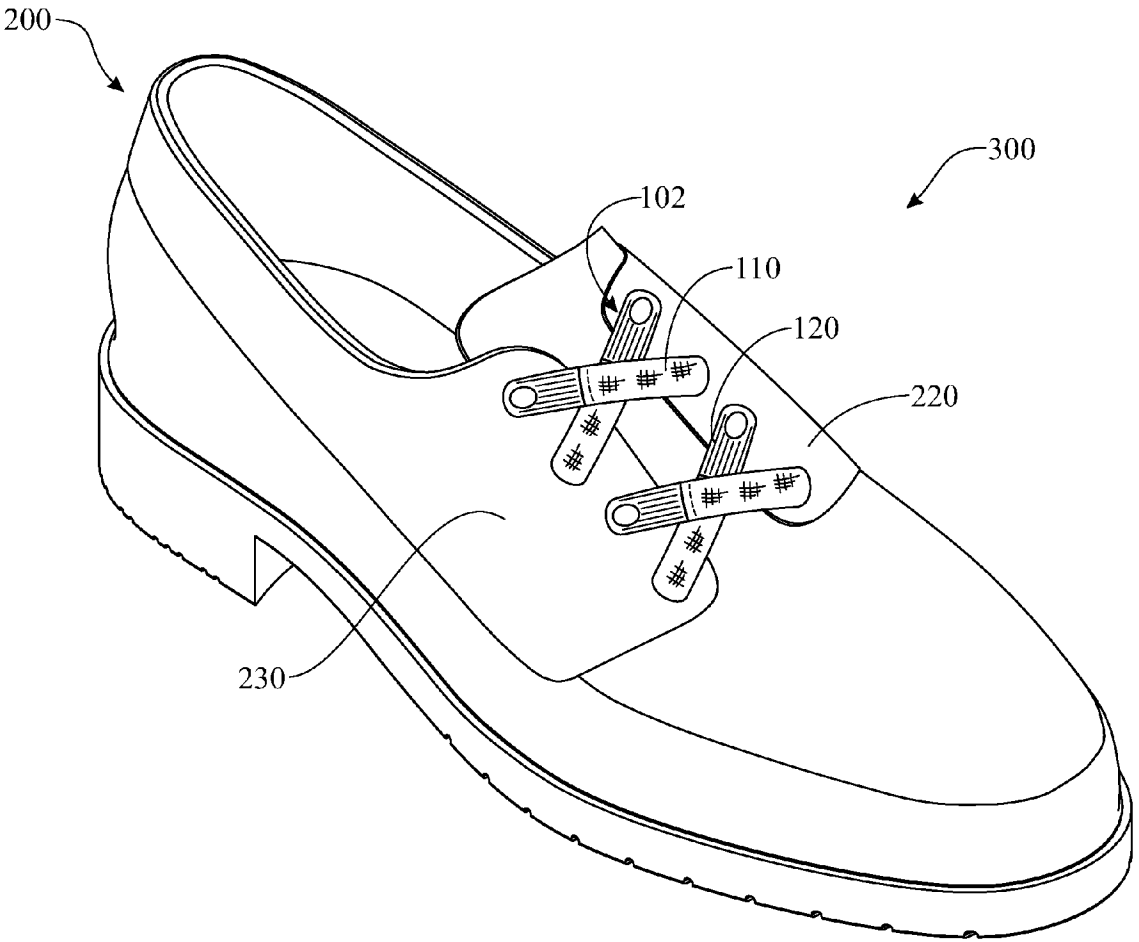
FIG. 6 presents an isometric view of an alternative embodiment shoe securing system, illustrating the system in a criss-cross fastened assembled configuration on the shoe.

Once the shoe securing system 100 is incorporated into a shoe 200, as described above, the shoe 200 can be selectively fastened and unfastened as desired by the user, as best illustrated in FIGS. 4 and 5. The user can engage the attachment feature 118, implemented as a plurality of loops, affixed to the strap attachment section 130, with the mating attachment feature 168 affixed to the fabric section 110, the mating attachment feature 168 implemented as a plurality of hooks. The user can selectively adjust the tightness or looseness of the fit by selecting the point of engagement of the loop-type attachment feature 118 to the hook-type attachment feature 168, as is known in the art. It is understood that the plurality of straps can be configured in a multitude of configurations, such as the parallel configuration presented in FIGS. 4 and 5, as well as a crisscross configuration, as presented in FIG. 6.

In the present embodiment, as has been explained, the main body 102 is divided into two sections (elastic section 120 and fabric section 110). It is contemplated, however, that the main body 102 can be constructed in accordance with alternative embodiments, for instance in form of a strap made of a single material.

Preferably, as in the present embodiment, the main body 102 is longitudinally elastic, in order to provide a slight tightness when securing the shoe to the foot. In the present embodiment, longitudinal elasticity is achieved by providing the main body 102 with two sections, at least one of which (the elastic section 120) is longitudinally elastic. Alternative embodiments are contemplated in which the main body 102 is comprised of a variable number of sections, one or more of which are longitudinally elastic. Further embodiments are also contemplated in which the main body 102 is comprised of a single, elastic strap made of fabric, rubber, or other applicable elastic material.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A shoe securing system comprising:

a strap attachment section including a first female fastener defining a first male receiving aperture, and further including an attachment feature;

a shoe attachment strap including a strap main body, wherein said strap main body comprises:

a first end and an opposed second end arranged along a longitudinal direction, an attachment feature, affixed to a bottom surface of the strap main body at said first end, said attachment feature being adapted for selective engagement to the attachment feature of the strap attachment section, and a second female fastener integrated into said second end, the second female fastener defining a second male receiving aperture; and a first male fastener and a second male fastener adapted for frictional engagement and retention within a respective of the first and second male receiving apertures, wherein said attachment feature of the strap attachment section and said attachment feature of said strap main body comprise mating hooks and loops.

2. The shoe securing system of claim 1, wherein said strap main body is elastically deformable in said longitudinal direction.

3. The shoe securing system of claim 2, wherein said strap main body is defined by a fabric section and an elastic section.

4. The shoe securing system of claim 3, wherein said first end of said strap main body is comprised in said fabric section, and said opposed second end of said strap main body is comprised in said elastic section.

5. The shoe securing system of claim 4, wherein said fabric section and said elastic section are affixed at respective lateral ends thereof.

6. The shoe securing system of claim 1, wherein said strap attachment section is configured to fit beneath said strap main body when said attachment feature of said strap attachment section is engaged to said attachment feature of said strap main body.

7. The shoe securing system of claim 1, wherein the first and second male fasteners are comprised of a bulbous member supported by a neck member having a narrower width than a width of said bulbous member, wherein a size and shape of the bulbous member is adapted to be forcibly inserted within a male receiving aperture in a corresponding female fastener of said first and second female fasteners for frictional engagement and retention within said male receiving aperture.

8. The shoe securing system of claim 1, wherein said first and/or second male fasteners are integrally formed with a shoe upper section.

9. The shoe securing system of claim 1, wherein said first and/or second male fasteners are non-integrally formed with a shoe upper section.

10. The shoe securing system of claim 9, wherein said first and second male fasteners are configured to pass through an eyelet of said shoe upper section and protrude sufficiently outwardly from said eyelet to frictionally engage and to be retained within the respective first and second male receiving apertures.

11. The shoe securing system of claim 10, wherein said strap attachment section is shaped and sized to rest on a portion of a shoe upper surrounding said eyelet, providing alignment between said eyelet and said first male receiving aperture.

12. A shoe securing system comprising:

a strap attachment section including a first female fastener defining a first male receiving aperture, and further including an attachment feature; and a shoe attachment strap including a strap main body, wherein said strap main body comprises:

a first end and an opposed second end arranged along a longitudinal direction, an attachment feature, affixed to a bottom surface of the strap main body at said first end, said attachment feature being adapted for selective engagement to the attachment feature of the strap attachment section, and a second female fastener integrated into said second end, the second female fastener defining a second male receiving aperture, wherein said attachment feature of the strap attachment section and said attachment feature of said strap main body comprise mating, hooks and loops.

13. The shoe securing system of claim 12, wherein said strap main body is elastically deformable in said longitudinal direction.

14. The shoe securing system of claim 12, wherein said strap attachment section is configured to fit beneath said strap main body when said attachment feature of said strap attachment section is engaged to said attachment feature of said strap main body.

* * * * *